United States Patent [19]

Campbell et al.

[11] Patent Number: 4,750,630

[45] **Date of Patent: * Jun. 14, 1988**

[54] BABY BOTTLE WITH INTEGRAL HANDLE

[76] Inventors: William O. Campbell; Nickie G. Campbell, both of 2633 N. Country Club Rd., Muskogee, Okla. 74403

[ * ] Notice: The portion of the term of this patent subsequent to Feb. 18, 2003 has been disclaimed.

[21] Appl. No.: 89,956

[22] Filed: Aug. 25, 1987

Related U.S. Application Data

[63] Continuation of Ser. No. 790,090, Oct. 22, 1985, abandoned, which is a continuation of Ser. No. 597,388, Apr. 6, 1984, Pat. No. 4,570,808.

[51] Int. Cl.[4] ..... A61J 9/00; A61J 9/06; B65D 23/10

[52] U.S. Cl. ..... 215/11.1; 215/100 A; 220/94 A

[58] Field of Search ..... 215/1 R, 100 A, 11 R-11 E; 220/85 E, 85 H, 94 A; 248/102; D9/372, 374, 382, 383, 378; D24/47, 48, 46

[56] References Cited

U.S. PATENT DOCUMENTS

| | | | |
|---|---|---|---|
| D. 18,420 | 7/1888 | Geyer | D24/47 |
| D. 47,650 | 7/1915 | Roach | D9/382 |
| D. 71,125 | 9/1926 | Becker | D9/382 |
| D. 86,570 | 3/1932 | Humphreys . | |
| D. 92,518 | 6/1934 | Briner | D58/5 |
| D. 124,394 | 12/1940 | Service . | |
| D. 183,940 | 11/1958 | Luxardo et al. | D9/382 |
| D. 187,360 | 3/1960 | Hoffstein | D24/48 |
| D. 192,978 | 6/1962 | Garvey | D9/01 |
| D. 195,599 | 7/1963 | Platte et al. | D58/6 |
| D. 199,699 | 12/1964 | Dailey | D58/8 |
| D. 210,501 | 3/1968 | Brammer | D9/372 |
| D. 212,921 | 12/1968 | Bloomberg | D83/8 |
| D. 214,871 | 8/1969 | Tompkins | D9/01 |
| D. 216,248 | 12/1969 | Hills | D9/42 |
| D. 221,517 | 8/1971 | Luedtke | D24/04 |
| D. 224,200 | 7/1972 | Kretz | D9/41 |
| D. 229,723 | 12/1973 | Grimes | D9/01 |
| D. 239,697 | 4/1976 | Hunt | D9/383 |
| D. 240,968 | 8/1976 | Hurst | D28/01 |
| D. 273,276 | 4/1984 | Klim | D9/383 |
| D. 276,791 | 12/1984 | Field | D9/382 |
| D. 283,920 | 5/1986 | Chen | D24/47 |
| D. 284,220 | 6/1986 | Pote | D24/48 |
| 595,414 | 12/1897 | Roach | 215/11 R |
| 1,037,309 | 9/1912 | Poore | 215/11 B |
| 1,375,917 | 4/1921 | Paugh | 215/11 R |
| 1,617,213 | 2/1927 | Paugh | 215/11 C |
| 1,637,719 | 8/1927 | Whitlock . | |
| 1,668,227 | 5/1928 | Beck . | |
| 1,947,753 | 2/1934 | Block | 215/11 |
| 2,307,390 | 1/1943 | Chew | 215/1 |
| 2,586,199 | 2/1952 | Backus | 220/94 A |
| 2,722,086 | 11/1955 | Mullen | 215/1 R |
| 2,789,002 | 4/1957 | Nicholas | 294/33 |
| 2,793,778 | 5/1957 | Maxwell | 215/11 R |
| 2,831,596 | 4/1958 | Eyles | 215/11 R |
| 2,843,281 | 7/1958 | Gallois | 215/11 |
| 2,859,891 | 11/1958 | Carkin | 215/11 |

FOREIGN PATENT DOCUMENTS

| | | | |
|---|---|---|---|
| 0063033 | 10/1982 | European Pat. Off. | 215/11 E |

OTHER PUBLICATIONS

U.S. Trademark Application Ser. No. 464,296.

U.S. Trademark Reg. No. 727,833.

Pediatrics, (vol. 6, 1898), "The Feeding of Infants" by J. Darwin Nagle, M.D.

*Primary Examiner*—William Price

*Assistant Examiner*—Sue A. Weaver

[57] ABSTRACT

A baby bottle particularly designed and constructed for supporting thereof by the baby or infant itself during a feeding operation. The bottle container a container having at least one integral element of a circumferential dimension sufficiently small for encircling thereof or grasping thereof the baby's small hands whereby the baby may independently support the bottle during a feeding operation without the assistance of an attendant, or the like.

1 Claim, 1 Drawing Sheet

| | | | |
|---|---|---|---|
| 2,978,131 | 4/1961 | Garvey | 215/1 |
| 2,986,296 | 5/1961 | Bannister et al. | 215/11 R |
| 3,075,666 | 1/1963 | Hoffstein | 215/11 |
| 3,105,324 | 10/1963 | Friedman | 215/11 R |
| 3,145,867 | 8/1964 | Roberts et al. | 215/11 |
| 3,161,311 | 12/1964 | Boston | 215/11 |
| 3,171,559 | 3/1965 | Ferree | 215/1 |
| 3,195,752 | 7/1965 | Cox | 215/1 |
| 3,214,052 | 10/1965 | Dike | 215/10 |
| 3,232,495 | 2/1966 | Schneider | 222/209 |
| 3,443,710 | 5/1969 | Hills | 215/1 R |
| 3,718,360 | 2/1973 | Knutzen | 294/27 H |
| 3,746,198 | 7/1973 | Howland | 215/11 R |
| 3,804,952 | 4/1974 | MacDonald | 426/117 |
| 3,990,596 | 11/1976 | Hoftman | 215/11 R |
| 4,557,392 | 12/1985 | Ryan et al. | 215/11 R |
| 4,558,792 | 12/1985 | Cabernoch et al. | 215/11 R |
| 4,570,808 | 2/1986 | Campbell et al. | 215/11 R |

BABY BOTTLE WITH INTEGRAL HANDLE

This is a continuation of copending application Ser. No. 790,090 filed on 10-22-85 now abandoned which is a continuation of Ser No. 597,388 filed on Apr. 6, 1984 now U.S. Pat. No. 4,570,808.

BACKGROUND OF THE INVENTION

1. Field of the Invention

This invention relates to improvements in baby bottles and more particularly, but not by way of limitation, to a baby bottle configured for ease of holding thereof by an infant during feeding.

2. Description of the Prior Art

The feeding of babies or infants by use of a bottle containing a liquid retrievable through a nipple means provided at the open end of the bottle is widespread today. The bottles are usually of a generally cylindrical configuration, and are designed or constructed for containing a preselected known quantity of the liquid, with segments of the quantity usually being indicated or inscribed on the walls of the bottle for facilitating the determination of the amount of food being ingested by the infant. The usual baby bottle in use today is of an outer circumference larger than that easily surrounded by the small hands of the baby or infant, and as a result it is difficult for the child or infant to support the bottle itself during feeding. This is a disadvantage in that it normally requires the services of an adult or larger person to feed the baby using the baby bottle. Attempts to solve the problem have been made, as shown in the Briner patent Des. No. 92,518; Hunt patent No. Des. 239,697; Garvey patent No. Des. 192,978; Tompkins patent No. Des. 214,871; Poore patent No. 1,037,309, Roach patent No. 595,414; Maxwell patent No. 2,793,778; Paugh patent No. 1,617,213; and Nicholas patent No. 2,790,002. The Briner patent discloses a bottle having a generally centrally disposed recess in the bottle and the Garvey patent shows a bottle having an opening in the body thereof, the opening merely defining an offset handle member. The Roach patent relates to a nursing bottle having an opening extending entirely through the body of the bottle, but the opening is in the upper portion of the bottle, and is particularly provided for facilitating the permanent fastening of the nipple to the bottle to preclude loss or swallowing of the nipple by the baby, and is not directed to the problem of holding of the bottle by the infant or the baby itself.

SUMMARY OF THE INVENTION

The present invention contemplates a novel baby bottle or nursing bottle which is particularly designed and constructed for overcoming the foregoing disadvantages. In one embodiment of the invention, the bottle is provided with an elongated centrally disposed opening extending through the body of the bottle and providing spaced oppositely disposed hollow portions having a circumferential dimension small enough for ready encircling thereof by the small hands of the baby. Thus, the baby may easily support the bottle without assistance or with a minimum of assistance during feeding from the contents of the bottle. In another embodiment of the invention, the bottle is provided with three angularly spaced generally tubular longitudinally extending sections integrally secured together by a recessed central portion of the bottle in such a manner that each longitudinal section is of a circumferential dimension readly engagable by the hands of the infant. The baby or infant may readily hold the bottle during feeding, thus facilitating the feeding operation and freeing the parent, nurse, or other attendant during the feeding operation. The novel improved baby bottle is simple and efficient in operation and economical and durable in construction.

DETAILED DESCRIPTION OF THE PREFERRED EMBODIMENTS

Figure 1:
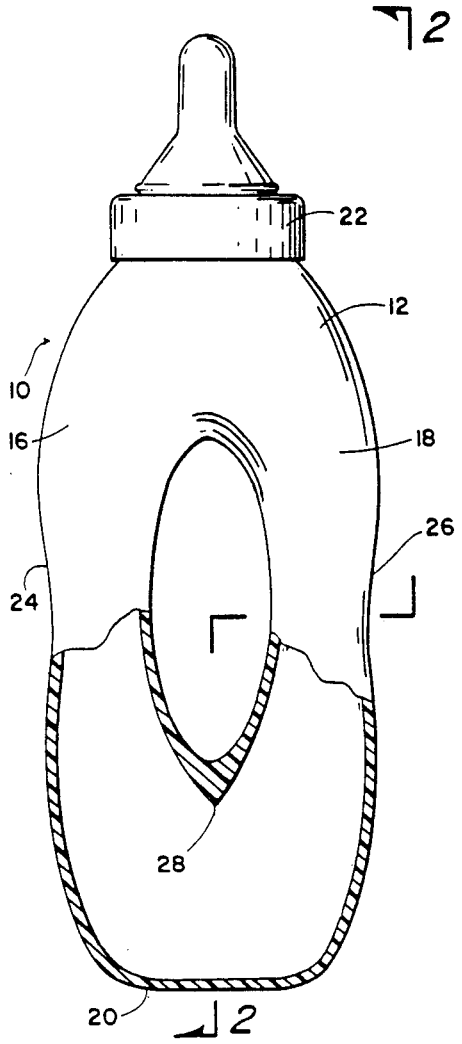
FIG. 1 is a front elevational view of a baby bottle embodying the invention, with a portion thereof shown in section for purposes of illustration.
Figure 2:
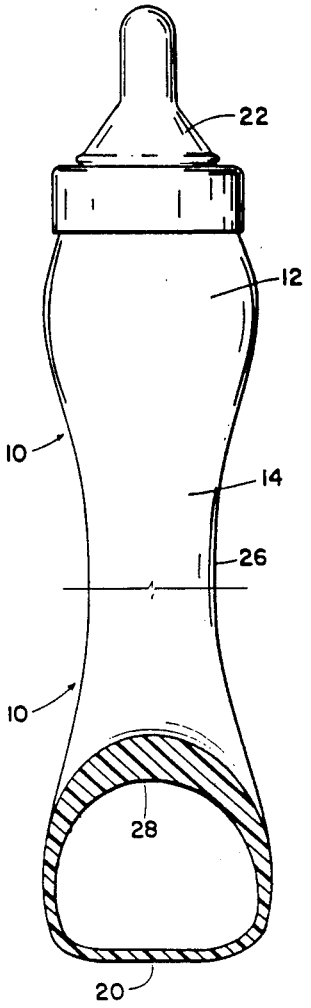
FIG. 2 is a view taken on line 2—2 of FIG. 1.

Referring to the drawings in detail, and particularly FIGS. 1 and 2, reference character 10 generally indicates a baby bottle comprising a generally elongated container 12 preferably constructed from a suitable plastic material but not limited thereto, and having a central opening 14 extending therethrough. The opening 14 is preferably somewhat elongated, providing a pair of separate elongated tubular portions or elements 16 and 18 having the opposite ends thereof in open communication with each other at the opposite or upper and lower ends of the opening 14. The bottom of the container 12 is closed by a plate or wall member 20, as is well known, and the upper end thereof is open for removably receiving the usual nipple means 22 thereon in the normal manner of baby bottles.

The longitudinal central portion of each element 16 and 18 is preferably of a somewhat smaller diameter than the end portions of each as shown at 24 and 26, respectively, thus providing a concave configuration for the outer periphery of each element 16 and 18. The reduced diameter portions 24 and 26 are preferably disposed substantially at the longitudinal center of the opening 14 and the concave-type configuration in cooperation with the opening 14 provides a bottle portion which may be easily engaged by the hand of a baby or infant for supporting of the bottle during a feeding operation.

The peripheral portion of the opening 14 which is disposed within the interior of the container 12 preferably terminates at the lower end thereof in a relatively sharp or pointed member 28 which is readily accessible from the interior of each element 16 and 18. The upper end of the opening 14 may be of substantially any internal configuration, but it is preferably substantially arcuate. The termination of the interior of the opening 14 at the pointed member 28 facilitates the clearing of the interior of the container 12 when the usual bottle brush or the like (not shown) is inserted into and through the tubular portions 16 and 18. Thus, the bottle 10 may be efficiently and easily cleaned in the well known manner presently in widespread use in connection with baby bottles.

In use, the elongated or tubular member 16 and 18 may be readily grasped by the small hands of a baby or infant whereby the baby may hold or support its own bottle during a feeding operation. The baby may grasp either a single tubular element, or may grasp a tubular element in each of its hands, as desired, thus greatly facilitating the feeding of the baby by releasing an attendant from constant tending of the infant during the feeding operation. This is not only of assistance to the attendant, but also may give the infant or baby a sense of well being.

From the foregoing it will be apparent that the present invention provides a novel baby bottle particularly configured to provide a bottle portion dimensioned for the small hand of the baby or infant using the bottle during a feeding operation. The baby may grasp the bottle by either one or two hands and can be fully independent of outside assistance during the use of the bottle.

Whereas the present invention has been described in particular relation to the drawings attached hereto, it should be understood that other and further modifications, apart from those shown or suggested herein may be made within the spirit and scope of this invention.

What is claimed is:

1. A baby bottle comprising:

a unitary, elongated, fluid container body with a left side and a right side, having (a) a bottom half having a closed end;

(b) a top half having a neck thereon with an open end for removably receiving a nipple; and (c) an elongated opening whose longitudinal axis is formed to extend along the longitudinal axis of the elongated container body between said closed and open ends substantially equidistant between the left and right sides and extending substantially into both the top and bottom halves of the container body at approximately the center of gravity of the bottle to form a substantially balanced baby bottle when filled with liquid, said opening forming two substantially similar, elongated tubular members along the left and right sides of said bottom and top halves of the container body, each of said elongated tubular members having a first circumferential dimension in the vicinity of the opening which is smaller than a second circumferential dimension on the elongated tubular member in the vicinity of the opening, enabling the elongated tubular members to be grasped by a baby during feeding for independent, substantially balanced support of the container by the baby.

* * * * *